US006478009B1

(12) United States Patent
Seitz et al.

(10) Patent No.: US 6,478,009 B1
(45) Date of Patent: Nov. 12, 2002

(54) MULTICYLINDER INTERNAL COMBUSTION ENGINE WITH AN ENGINE BRAKING SYSTEM

(75) Inventors: Hans Felix Seitz, Graz (AT); Gabor Hrauda, Graz (AT); Christian Auer, Haag (AT); Robert Roithinger, St. Valentin (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/078,486

(22) Filed: Feb. 21, 2002

(30) Foreign Application Priority Data

May 4, 2001 (AT) ..... 352/2001

(51) Int. Cl.[7] ..... F02D 13/04
(52) U.S. Cl. ..... 123/321; 123/41.31; 123/320
(58) Field of Search ..... 123/320, 324, 123/402, 41.31

(56) References Cited

U.S. PATENT DOCUMENTS 3,963,379 A 6/1976 Ueno
5,526,784 A * 6/1996 Hakkenberg et al. ..... 123/321
6,138,084 A * 10/2000 Mine ..... 701/207
6,189,504 B1 * 2/2001 Israel et al. ..... 123/321

FOREIGN PATENT DOCUMENTS

| | | |
|---|---|---|
| DE | 2502650 | 7/1976 |
| DE | 3428626 | 2/1986 |
| EP | 0828061 | 3/1998 |
| EP | 0898059 | 2/1999 |

* cited by examiner

*Primary Examiner*—Bibhu Mohanty
(74) *Attorney, Agent, or Firm*—Dykema Gossett PLLC

(57) ABSTRACT

The invention relates to a multicylinder internal combustion engine with an engine braking system including intake and exhaust valves and at least one additional brake valve for each cylinder, the exhaust valves opening into an exhaust system. Further a preferably tubular pressure reservoir with a pressure regulating valve is provided, into which braking channels departing from the brake valves are leading, so that a gas exchange between the individual cylinders is possible upon actuation of the brake valves.

17 Claims, 4 Drawing Sheets

MULTICYLINDER INTERNAL COMBUSTION ENGINE WITH AN ENGINE BRAKING SYSTEM

BACKGROUND OF THE INVENTION

The invention relates to a multicylinder internal combustion engine with an engine braking system, including intake and exhaust valves and at least one additional brake valve for each cylinder, the exhaust valves opening into an exhaust system.

Braking systems that are integrated in automotive engines, and especially in truck engines, have become more and more important over the years, since they represent cost-efficient and space-saving additional braking systems. In order to meet the increased specific power of modern truck engines, however, increased braking power is required.

DESCRIPTION OF PRIOR ART

An engine brake of the above type is known from DE 34 28 626 A describing a four-stroke engine comprising two cylinder groups of four cylinders each. Each cylinder is provided with charge exchange valves and one additional exhaust valve. In the braking mode the additional exhaust valves remain open during the entire braking process. Moreover, a shaft-mounted throttle valve is positioned in the joint exhaust passage of the two cylinder groups, the position of which can be controlled by an actuating element via a control rod. The disadvantage of this known system is its dependence on engine speed, and above all a relatively low braking power in the lower speed range.

In DE 25 02 650 A a valve-controlled reciprocating engine is described, where during the braking process compressed air is delivered via a compressed air valve into a storage tank, and returned via the same compressed air valve to furnish energy during start-up.

In the same context EP 0 898 059 A discloses an engine brake with a decompression valve, by means of which a compressed air generator will be obtained for all operational states of the engine. A pressure tank of a compressed air system is filled via a bypass line with compressed gas from the combustion space in the cylinders. One or more cylinders may be used for supplying the compressed air system.

In EP 0 828 061 A an engine brake is described in which a gas exchange between the individual cylinders is made possible by a common exhaust manifold. The gas exchange takes place via the exhaust valves of the six-cylinder engine. Unfortunately, the braking force obtainable by this engine braking system is relatively low.

SUMMARY OF THE INVENTION

It is the object of the present invention to further develop a multicylinder engine with an engine braking system as described above in such a way as to ensure maximum braking power over the entire speed range of the engine. The system should be simple, cost-efficient and reliable, and should not reduce engine performance upon actuation. It is a further object to propose a compact design with optimum thermodynamic properties, and to enable the driver to match the additional braking power of the engine braking system with the individual situation encountered on the road.

This object is achieved in the invention by proposing a preferably tubular pressure reservoir with a pressure regulating valve, into which braking channels departing from the brake valves will lead so that a gas exchange between the individual cylinders will be possible upon actuation of the brake valves. It will be of special advantage if the pressure regulating valve is provided with control signals depending on the position of a braking switch or brake pedal.

An essential component of the engine braking system according to the invention is the "brake rail", i.e., a preferably tubular pressure reservoir permitting a gas exchange between the individual cylinders in the braking mode. The additional braking power of the engine brake can be adjusted to actual operating parameters via a number of distinct positions on a braking switch or brake pedal in the passenger cabin.

The pressure reservoir may be designed for direct integration in the cylinder head of the internal combustion engine, or as an external pressure tube similar to an inlet or exhaust reservoir.

It is provided in an advantageous variant of the invention that the pressure reservoir comprise a device for cooling the gas volumes exchanged between individual cylinders, which is preferably integrated into the coolant circulation system of the engine. Advantageously, the cooling device includes a cooling jacket passed through by the coolant, which envelops the tubular pressure reservoir. For transverse scavenging of the individual cylinder heads the cooling jacket may be provided with a coolant port for each cylinder, the cooling jacket acting as a coolant collector in this case.

It is further provided in the invention that the cooling jacket has a brake channel port for each cylinder, which is connected to the corresponding brake channel, and that a hydraulic fluid line be integrated in the cooling jacket, which is provided with a fluid port for each cylinder, leading to the corresponding brake valve. The cooled brake rail thus is a compact component whose functions are as follows:

- Recirculating the coolant from the individual cylinder heads into the coolant circulation system,
- Providing a pressure line for hydraulic fluid supplied by a separate hydraulic pump and used for operation of the brake valves,
- Allowing for a gas exchange between the individual cylinders and recirculating the exhaust gas via the pressure regulating valve into the exhaust recirculation system,
- Use as exhaust cooler.

For easy mounting of the individual elements it is proposed by the invention that the ports for coolant, brake channel and hydraulic fluid all are located in a common flange plane.

Furthermore, the cooling device may be provided with a thermostatic coolant control element which preferably is positioned in the coolant circulation system of the internal combustion engine. In this way advantages may be obtained for the warm-up period of the engine.

For optimum thermal transfer from the coolant to the gases in the pressure reservoir, the latter may be provided with cooling fins on the inside. The invention is not only suitable for engines with single cylinder heads, but could also be integrated in a common cylinder head.

Actuation of the brake valves in the braking mode of the engine may be effected via a hydraulical, electrical or mechanical drive, or a combination thereof. The brake rail proposed by the invention will only serve to build up braking pressure, or to promote gas exchange between the cylinders, and the brake rail volume may be kept small, since no conventional valve lift will reduce the pressure level in the brake rail (as would be the case with exhaust brakes). The novel engine braking system will thus tolerate operating pressures that are considerably higher (up to about 20 bar) than those of known exhaust braking systems, where the brake and decompression valves are constantly open during braking and will lead directly into the exhaust train. To reduce thermal load in the braking mode of the engine the pressure reservoir, or rather, the brake rail may be integrated into the engine cooling system and surrounded by the cooling water of the engine.

The brake valves of the engine braking system according to the invention are timed and actuated several times per engine operating cycle. For a more detailed description, see the discussion of preferred variants (FIG. 2). The brake valves of the engine braking system of the invention are especially designed to meet the high pressures encountered during braking (up to 20 bar), permitting comparatively small valves with low valve lifts to be used. With conventional exhaust braking systems, on the other hand, the pressure in the exhaust train is restricted to not more than 5 bar, simply by the opening of the large conventional exhaust valves and the limited component strength.

Unlike with conventional systems, the pressure in the brake rail is hardly dependent on engine speed, thus yielding a much higher braking power at low engine speeds. Due to the small volume of the brake rail a shorter response time may be expected than with conventional systems, where the entire exhaust system down to the brake flap must be filled with compressed air before full braking power can be reached.

It is further provided that the preferably electronically controlled pressure regulating valve open into the exhaust system of the internal combustion engine.

Due to the high braking power of the system according to the invention it will not be necessary to provide a conventional exhaust back-pressure flap. As the exhaust train, contrary to the known exhaust back-pressure brake, is not shut, part of the generated braking heat may be carried off via the exhaust system by the exhaust gas stream, thus reducing the heat load on the components in the cylinder. If it is desirable, however, to further increase the braking power of the engine brake proposed by the invention, a conventional exhaust back-pressure flap may be provided in the exhaust system. In this instance the increased heat load in the cylinder must be taken into account.

BRIEF DESCRIPTION OF THE DRAWINGS

The invention will be discussed in more detail below, with reference to the enclosed drawings, wherein.

DETAILED DESCRIPTION OF THE PREFERRED EMBODIMENTS

Figure 1:
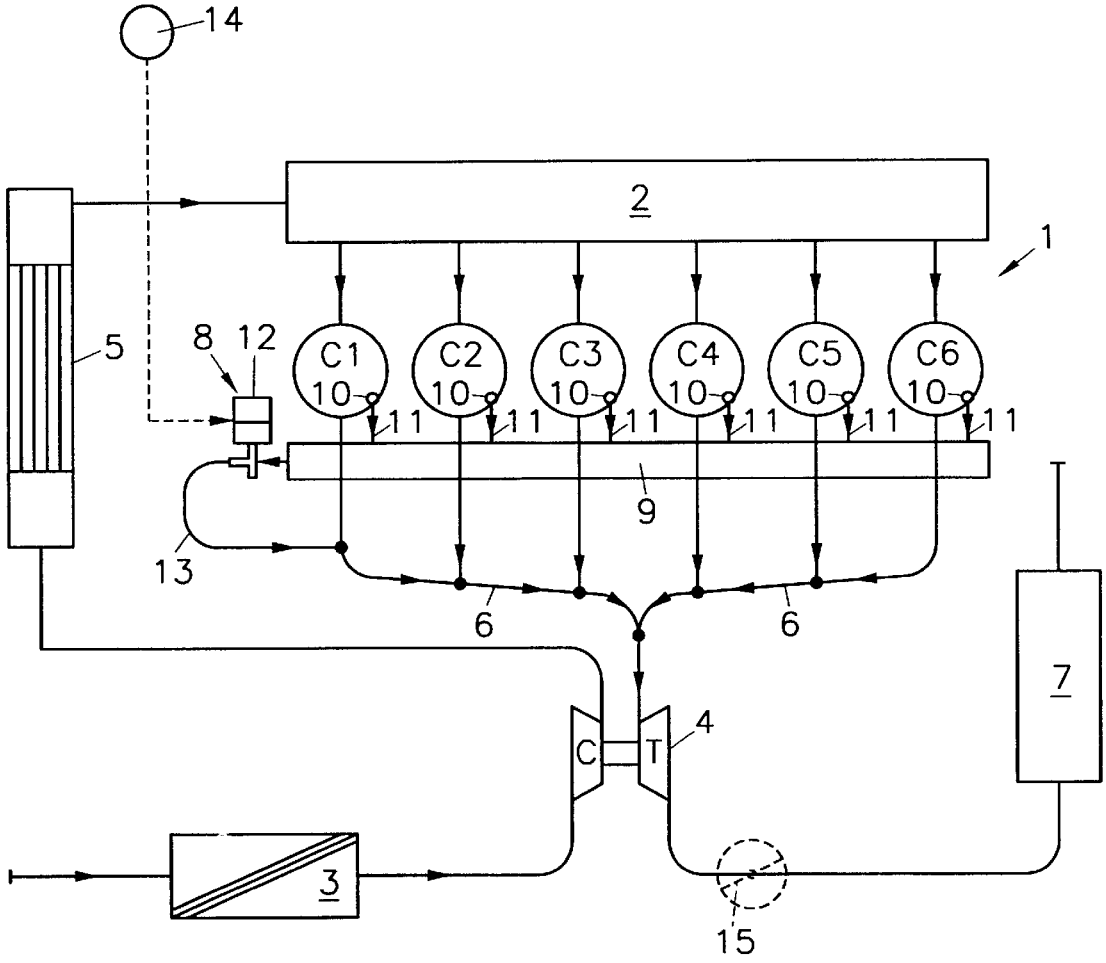
FIG. 1 is a schematical representation of an internal combustion engine with an engine braking system according to the invention.

In FIG. 1 the invention is explained more closely with reference to a six-cylinder turbocharged engine. It should be noted in this context that the functional principle of the engine braking system according to the invention is independent of the number of cylinders or the charging system, and could also be used with a naturally aspirated engine.

The six cylinders C1 to C6 of the internal combustion engine 1 are connected to an intake manifold 2 via intake ports not further shown in this drawing, which is supplied with charge air from the air filter 3 via the compressor part C of the turbocharger 4 and the intercooler 5. The exhaust valves of the internal combustion engine 1 open into the exhaust system 6, the exhaust gas being conventionally directed via the turbine part T of the turbocharger 4 and leaving the engine via a muffler 7.

The engine braking system 8 is provided with a tubular pressure reservoir 9 (brake rail) into which brake channels 11 lead, which depart from brake valves 10 and will allow a gas exchange between individual cylinders C1 to C6 at a relatively high pressure level.

In the braking mode of the engine 1 the brake valves 10 are actuated several times during an engine operating cycle, for example, there are two lifts of the brake valve in a cycle, the first brake lift occurring near upper dead center of the high pressure stroke. During this brake lift compressed air is pushed out of one of cylinders C1, C2, C3, C4, C5, or C6 and enters the brake rail 9 (valve lift $V_1$ in FIG. 2). In this way the brake rail 9 is filled with compressed air (up to approx. 20 bar operating pressure) while the expansion work of the cylinder is reduced, thereby generating braking power. Upon the closing of the intake valve the brake valve 10 will open once again (valve lift $V_2$ in FIG. 2), thus inducing a flow of compressed air from the brake rail 9 into the combustion chamber. As a consequence of the second lift of the brake valve the cylinder pressure will rise to the pressure level of the brake rail 9 at the beginning of the compression phase of the high pressure stroke. This will add to the compression work to be performed, and thus increase the braking power of the engine.

A pressure regulating valve 12, which may be timed electronically, will limit maximum pressure in the brake rail 9, to avoid damaging of the engine. This regulating valve 12 will further permit the driver to reduce the pressure in the brake rail 9, for example, by means of a braking switch 14 in the passenger compartment, by letting off compressed air from the brake rail 9 via a transfer line 13 into the exhaust system 6, such that the braking power can be adjusted to meet the actual driving situation.

As an alternative an exhaust back-pressure flap 15 is entered in the drawing by a broken line, for combination with the braking system of the invention.

The variant presented in FIGS. 3 to 6 shows the invention with reference to a four-cylinder engine, and is especially concerned with the details of a compact design of the brake rail. The pressure reservoir 9 is provided with a device 17 for cooling the gas volumes exchanged between the individual cylinders C1 to C4, which device 17 preferably is integrated into the coolant circulation system 16, 16' of the internal combustion engine. As indicated by arrow 16, the coolant will flow from the individual cylinder heads via the coolant ports 19 into the cooling jacket 18 surrounding the tubular pressure reservoir 9, and from there via a port on the front face of the cooling jacket 18 (see arrow 16') back into the coolant circulation system. The cooling jacket 18 acts as a coolant collector in this case.

Figure 4:
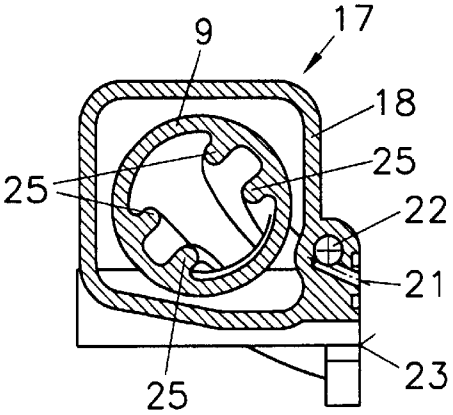

In a most compact design each cylinder is provided with a brake channel port 20 and a hydraulic fluid port 21 connected to a hydraulic fluid line 22 (see FIG. 4). All ports 19, 20, 21 are located in a common flange plane 23 of the cooling jacket 18, in which mounting bores 24 are provided.

Figure 2:
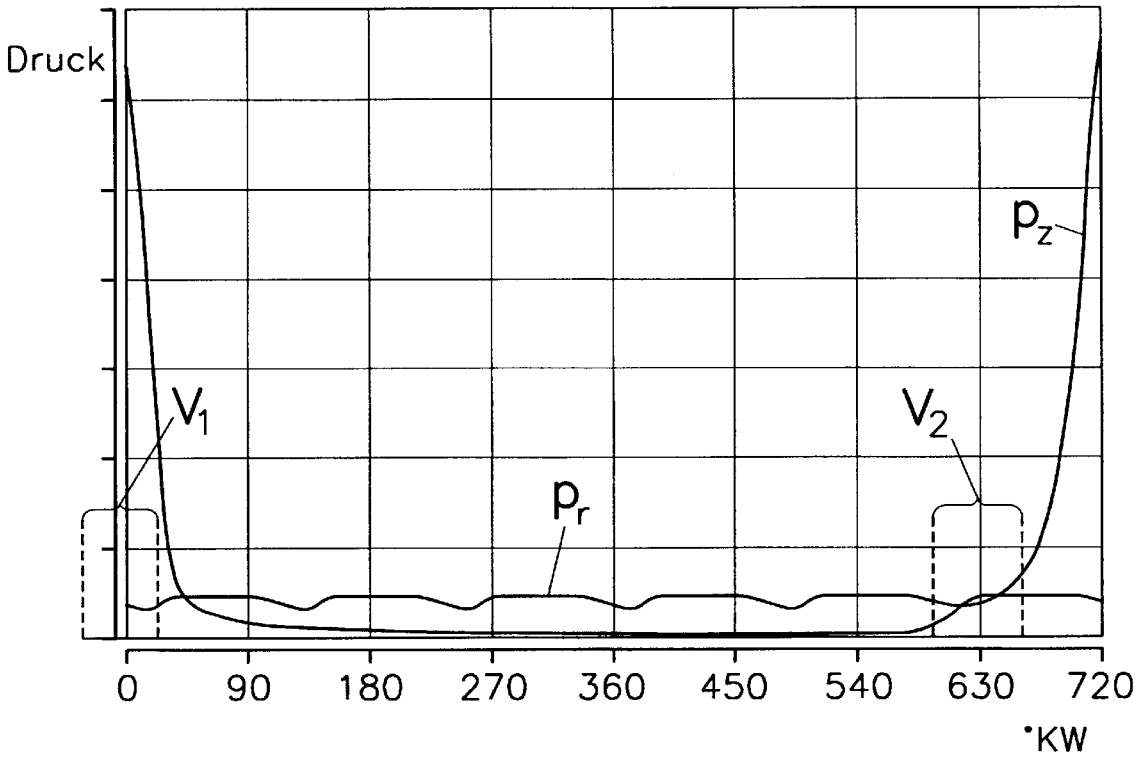
FIG. 2 is a diagram showing the pressure curve in the cylinder $p_z$ and pressure reservoir $P_r$ of the engine braking system.
Figure 3:
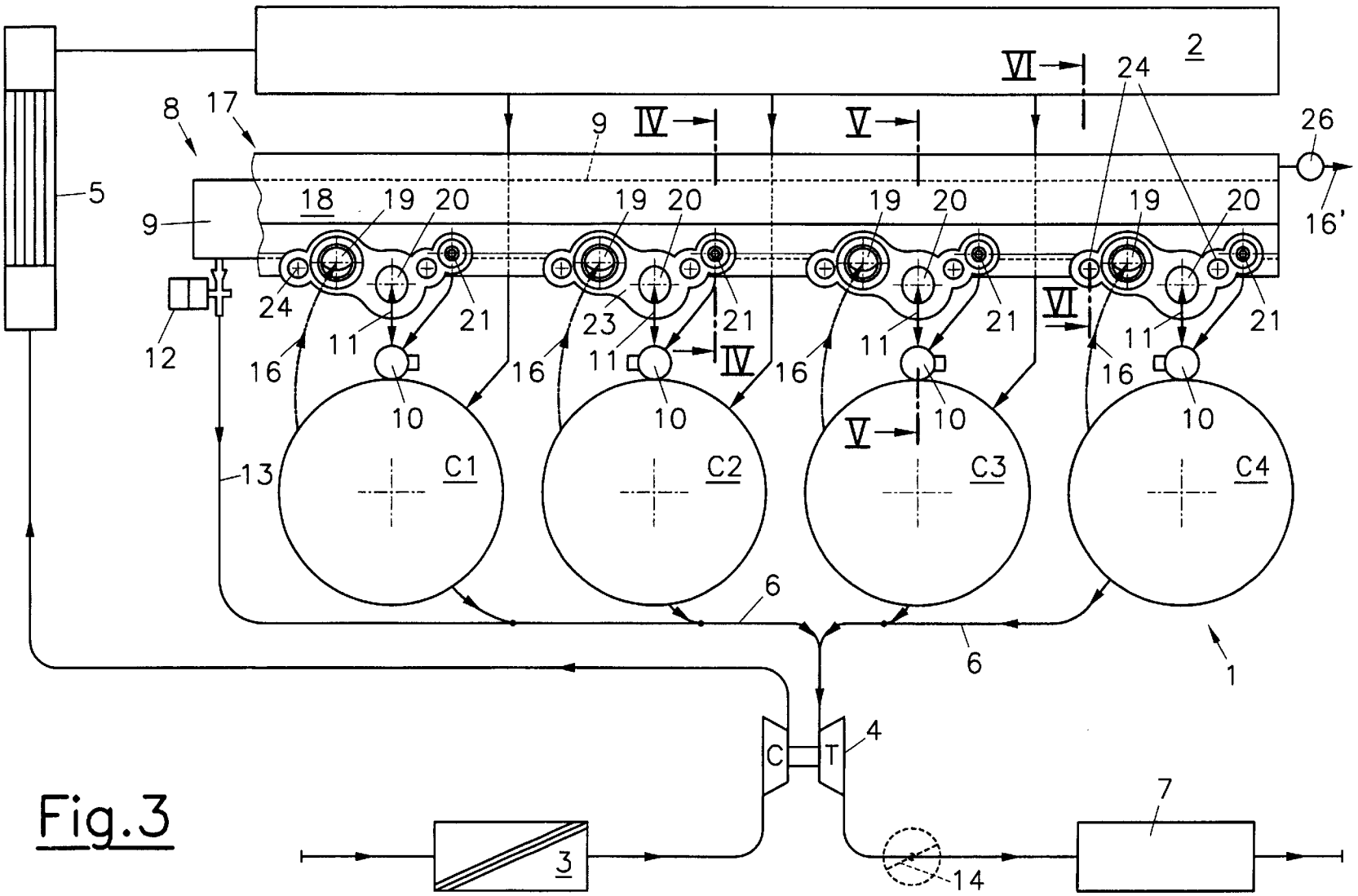
FIG. 3 is a variant of the invention according to FIG. 1, and FIGS. 4 to 6 are sectional representations along lines IV—IV, V—V, VI—VI in FIG. 3.
Figure 6:
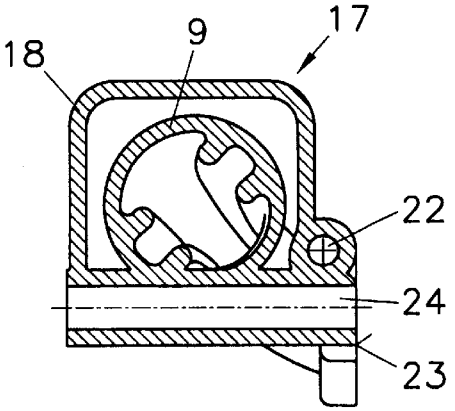
Figure 5:
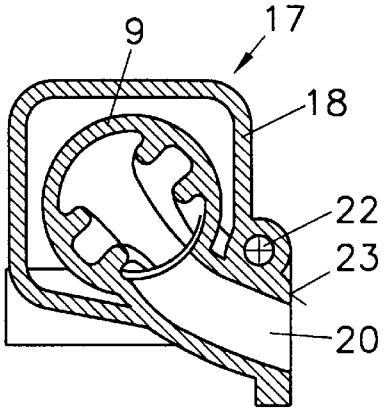

As shown in the sectional representations of FIGS. 2 to 4, the tubular reservoir 9 is provided with cooling fins 25 on the inside. The cooling device 17 may include a thermostatic coolant control element 26, which is preferably located in the coolant circulation system of the internal combustion engine. It would also be possible to provide a separate coolant circulation system for the brake rail (for example, as a bypass to the main coolant circulation system) and include a coolant control element there.

Since the engine braking system proposed by the invention will be operated independently of conventional intake and exhaust systems of the engine, the functioning of the engine brake will not depend on the respective charging system (naturally aspirated engine/conventional turbocharged engine/VTG). Engine performance will not be reduced upon actuation of the braking system.

What is claimed is:

1. Multicylinder internal combustion engine with an engine braking system including intake and exhaust valves and at least one additional brake valve for each cylinder of said combustion engine, said exhaust valves opening into an exhaust system, wherein a pressure reservoir with a pressure regulating valve is provided, into which pressure reservoir braking channels departing from said brake valves are leading, so that a gas exchange between each of said cylinders is possible upon actuation of said brake valves.

2. Internal combustion engine according to claim 1, wherein said pressure regulating valve is provided with control signals depending on the position of a braking switch or a brake pedal.

3. Internal combustion engine according to claim 1, wherein said pressure reservoir is tubular and comprises a cooling device for cooling gas volumes exchanged between said cylinders.

4. Internal combustion engine according to claim 3, wherein said cooling device is integrated into a coolant circulation system of said combustion engine.

5. Internal combustion engine according to claim 3, wherein said cooling device includes a cooling jacket passed through by the coolant, which envelops said tubular pressure reservoir.

6. Internal combustion engine according to claim 5, wherein said cooling jacket is provided with a coolant port for each of said cylinders.

7. Internal combustion engine according to claim 5, wherein said cooling jacket has a brake channel port for each of said cylinders, being connected to a corresponding brake channel.

8. Internal combustion engine according to claim 5, wherein a hydraulic fluid line is integrated into said cooling jacket of said cooling device, which is provided with a fluid port for each of said cylinders, leading to a corresponding brake valve.

9. Internal combustion engine according to claim 6, wherein said cooling jacket has a brake channel port for each of said cylinders, being connected to a corresponding brake channel, wherein a hydraulic fluid line is integrated into said cooling jacket of said cooling device, which is provided with a fluid port for each of said cylinders, leading to a corresponding brake valve and wherein said coolant port, said brake channel port, and said hydraulic fluid port all are located in a common flange plane.

10. Internal combustion engine according to claim 3, wherein said cooling device is provided with a thermostatic coolant control element.

11. Internal combustion engine according to claim 10, wherein said thermostatic coolant control element is positioned in a coolant circulation system of said combustion engine.

12. Internal combustion engine according to claim 1, wherein said pressure reservoir is provided with cooling fins on the inside.

13. Internal combustion engine according to claim 5, wherein said pressure reservoir is provided with cooling fins on the inside.

14. Internal combustion engine according to claim 1, wherein said brake valves are actuated via an hydraulical, electrical or mechanical drive, or a combination thereof.

15. Internal combustion engine according to claim 1, wherein said pressure regulating valve opens into said exhaust system of said combustion engine.

16. Internal combustion engine according to claim 15, wherein said pressure regulating valve is electronically controlled.

17. Internal combustion engine according to claim 1, wherein an exhaust back-pressure flap is provided in said exhaust system of said combustion engine.

* * * * *